US011443723B2

(12) United States Patent
Chang

(10) Patent No.: US 11,443,723 B2
(45) Date of Patent: Sep. 13, 2022

(54) MUSICAL INSTRUMENT HOLDER CLIP

(71) Applicant: TAIWAN CAROL ELECTRONICS CO., LTD., Taichung (TW)

(72) Inventor: Chao-Chih Chang, Taichung (TW)

(73) Assignee: TAIWAN CAROL ELECTRONICS CO., LTD, Taichung (TW)

( * ) Notice: Subject to any disclaimer, the term of this patent is extended or adjusted under 35 U.S.C. 154(b) by 0 days.

(21) Appl. No.: 17/387,160

(22) Filed: Jul. 28, 2021

(65) Prior Publication Data

US 2022/0130354 A1 Apr. 28, 2022

(30) Foreign Application Priority Data

Oct. 22, 2020 (TW) ..... 109136710

(51) Int. Cl.
*G10D 9/00* (2020.01)
*G10G 7/00* (2006.01)
*H04R 1/08* (2006.01)

(52) U.S. Cl.
CPC ..... *G10D 9/00* (2013.01); *G10G 7/00* (2013.01); *H04R 1/08* (2013.01)

(58) Field of Classification Search
CPC ..... G10D 9/00; G10G 7/00; H04R 1/08
See application file for complete search history.

(56) References Cited

FOREIGN PATENT DOCUMENTS

JP 08137464 A * 5/1996 ..... G10H 2230/221
TW 201223296 A 6/2012

OTHER PUBLICATIONS

Search Report appended to an Office Action, which was issued to Taiwanese counterpart application No. 109136710 by the TIPO dated May 19, 2021, with an English translation thereof.

* cited by examiner

*Primary Examiner* — Kimberly R Lockett

(57) ABSTRACT

A musical instrument holder clip includes a first holding unit and a second holding unit. The first holding unit includes a main body and a clamping member that extends movably into the main body, and is operable to generate a clamping force adapted for clamping a microphone between the main body and the clamping member. The second holding unit includes a first holding member adapted for abutting against an outer surface of a bell wall of a wind instrument, and a second holding member adapted for abutting against an inner surface of the bell wall of the wind instrument. The first holding member and the second holding member cooperatively define a holding space adapted for receiving the bell wall of the wind instrument therebetween.

10 Claims, 6 Drawing Sheets

MUSICAL INSTRUMENT HOLDER CLIP

CROSS-REFERENCE TO RELATED APPLICATION

This application claims priority to Taiwanese Invention Patent Application No. 109136710, filed on Oct. 22, 2020.

FIELD

The disclosure relates to a holder clip, and more particularly to a musical instrument holder clip that is adapted to secure a microphone to a wind instrument.

BACKGROUND

Conventionally, sound recording of musical instruments is mostly achieved by a microphone, which is mounted on a microphone holder. Sound is recorded when a performer stands near the microphone to perform with a musical instrument. However, the distance between the microphone and the musical instrument may change at times when the performer moves his/her body during the performance. Thus, fluctuations in the volume of the recorded sound are quite noticeable and such conditions affect the quality of sound recording.

A conventional string instrument holder disclosed in Taiwanese Patent No. M431407 was devised to improve the quality of sound recording through an implementation of a positioning bracket that is positioned in a string instrument, such that the volume of the recorded sound from the string instrument no longer fluctuates. However, this conventional holder is only applicable to string instruments with predefined sizes or dimensions, and thus not widely applicable. In addition, there is no holder device in the market that addresses sound recordings for wind instruments.

SUMMARY

Therefore, an object of the disclosure is to provide a musical instrument holder clip that can alleviate at least one of the drawbacks of the prior art.

According to the disclosure, the musical instrument holder clip is adapted for detachably interconnecting a microphone and a wind instrument. The wind instrument includes a bell wall. The musical instrument holder clip includes a first holding unit and a second holding unit.

The first holding unit includes a main body and a clamping member that extends movably into the main body. The first holding unit is operable to generate a clamping force between the main body and the clamping member that is adapted for clamping the microphone therebetween.

The second holding unit includes a first holding member that is connected to an outer surrounding surface of the main body, and a second holding member that is elastic and that is connected to the outer surrounding surface of the main body. The first holding member is adapted for abutting against an outer surface of the bell wall of the wind instrument. The second holding member is adapted for abutting against an inner surface of the bell wall of the wind instrument. The first holding member and the second holding member cooperatively define a holding space that is adapted for receiving the bell wall of the wind instrument therebetween.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
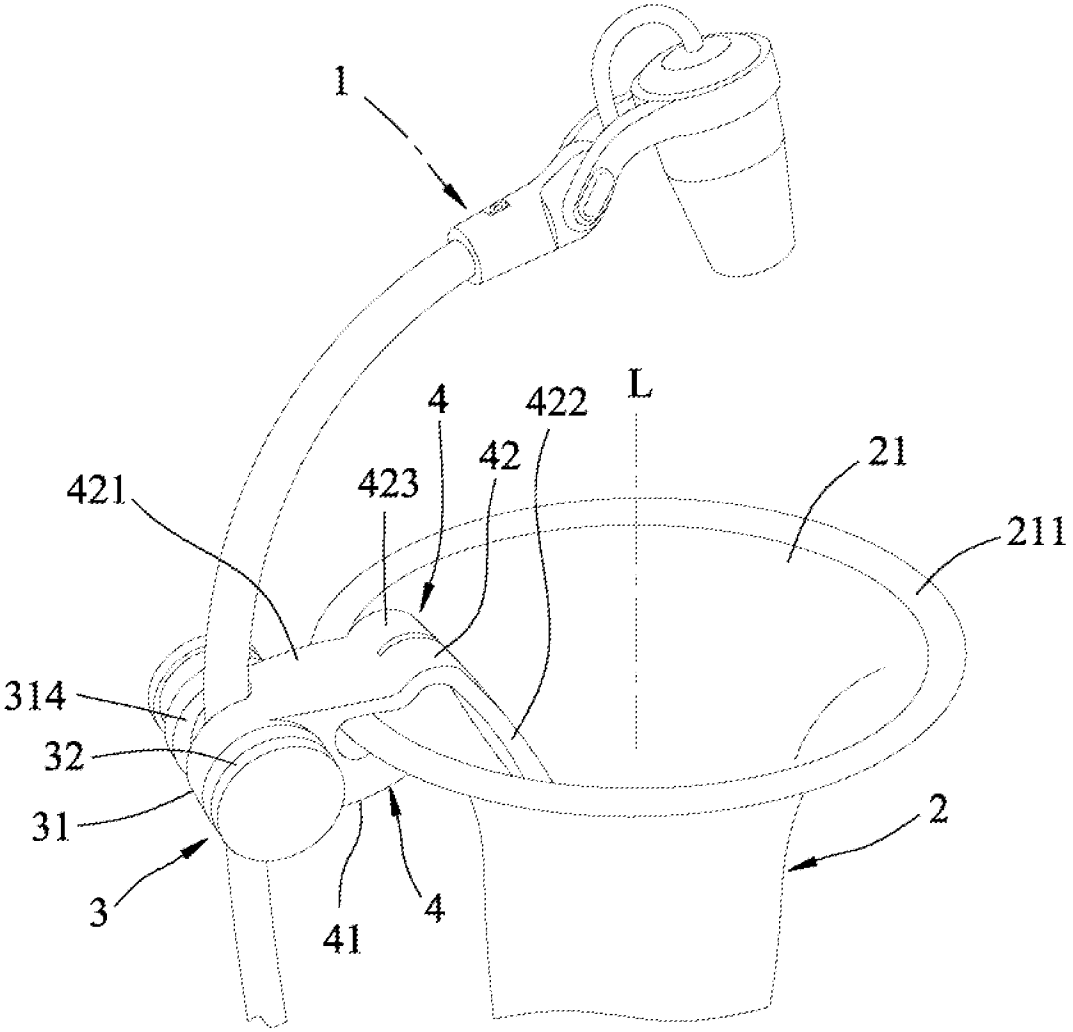
FIG. 1 is perspective view illustrating an embodiment of a musical instrument holder clip according to the disclosure that is interconnected with a microphone and a wind instrument.
Figure 2:
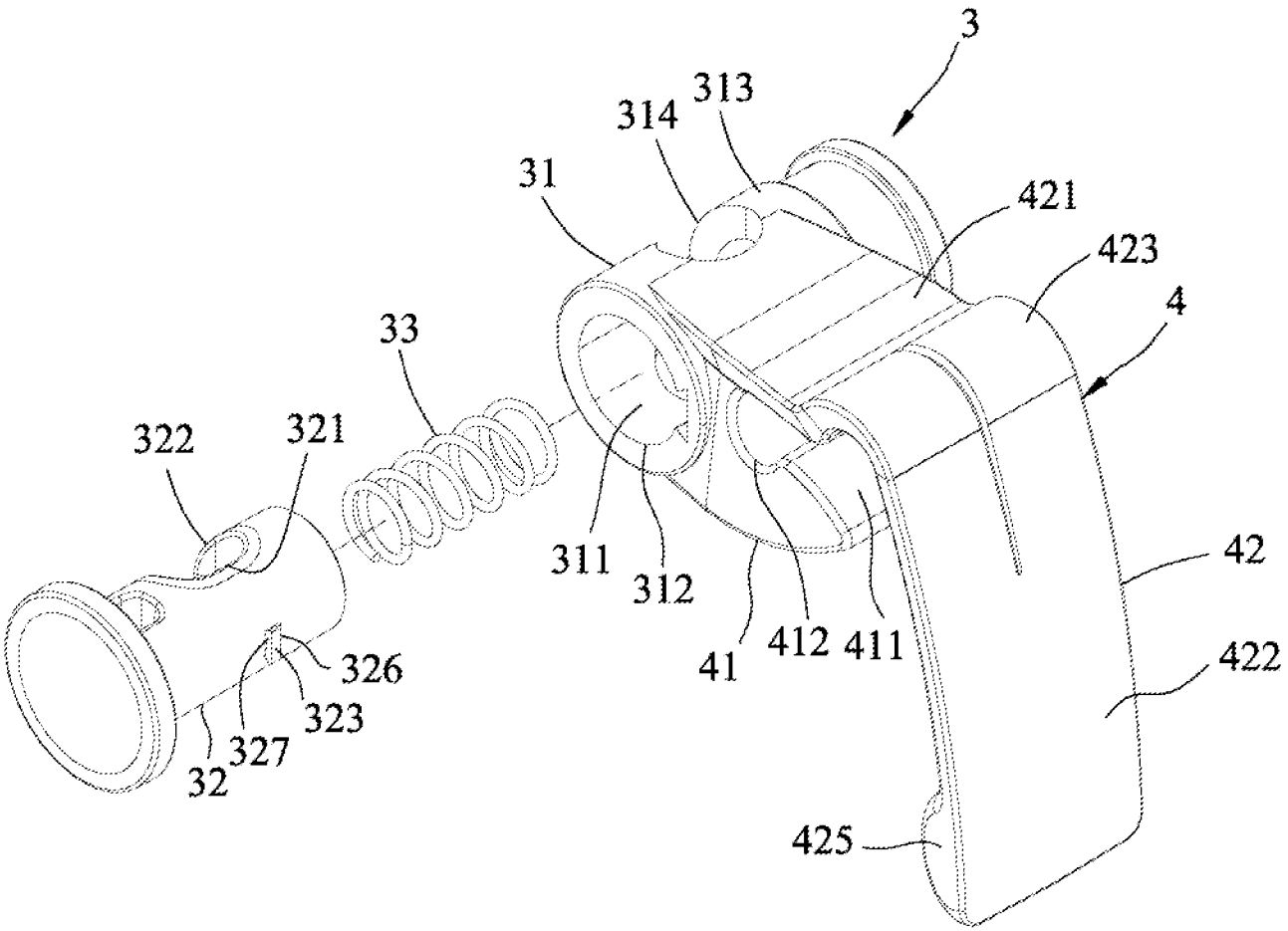
FIG. 2 is an exploded perspective view illustrating the embodiment.

Referring to FIGS. 1 and 2, an embodiment of a musical instrument holder clip according to the disclosure is adapted for detachably interconnecting a microphone 1 and a wind instrument 2. In this embodiment/the wind instrument 2 is a saxophone, and includes a bell wall 21 that surrounds an axis (L) and that has a bell rim 211. The musical instrument holder clip includes a first holding unit 3 and a second holding unit 4.

The first holding unit 3 includes a main body 31, a clamping member 32 that extends movably into the main body 31 and that is adapted for clamping a microphone 1 with the main body 31, and a resilient member 33 that is disposed in the main body 31.

Figure 3:
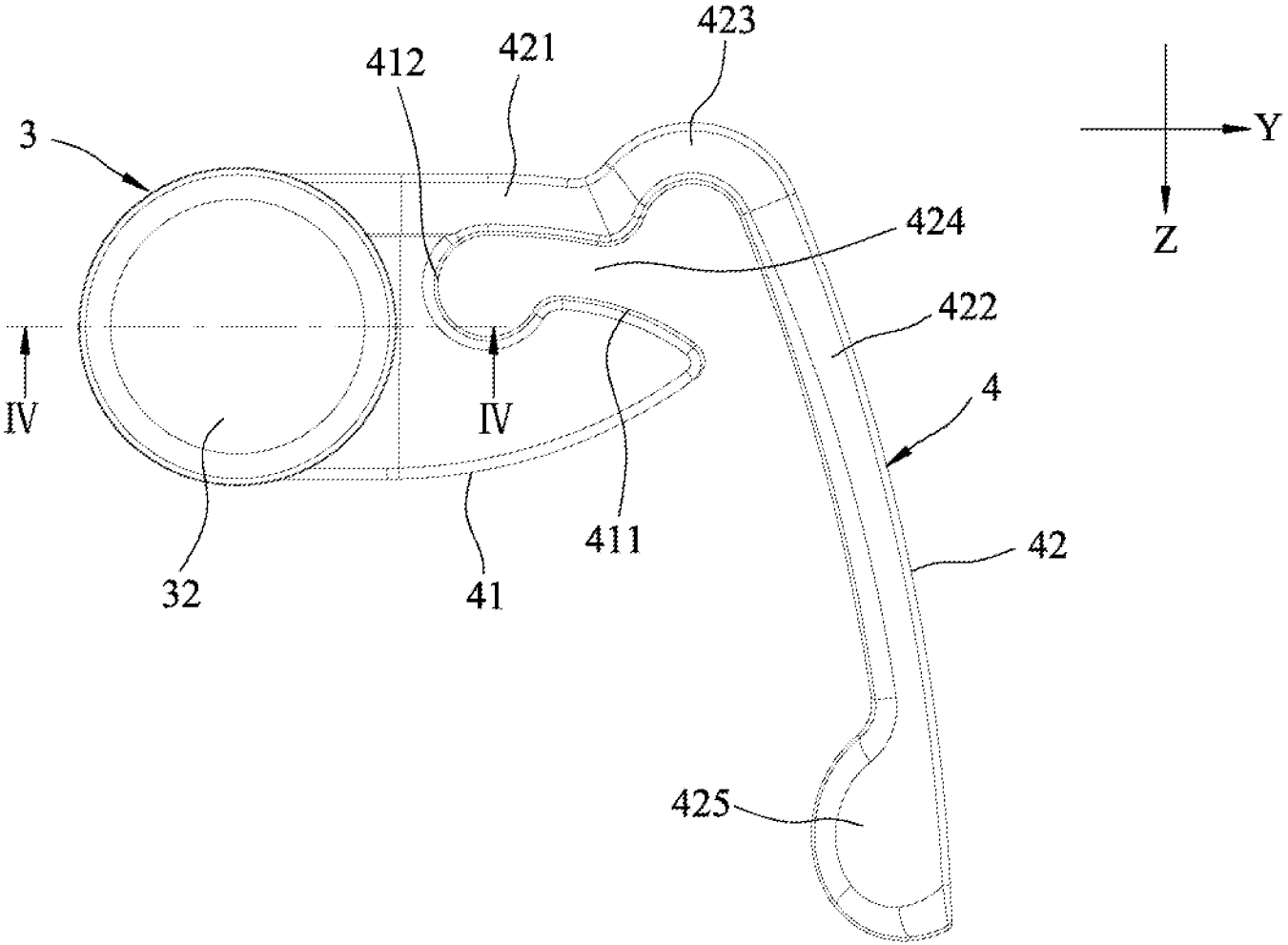
FIG. 3 is a side view of the embodiment.
Figure 4:
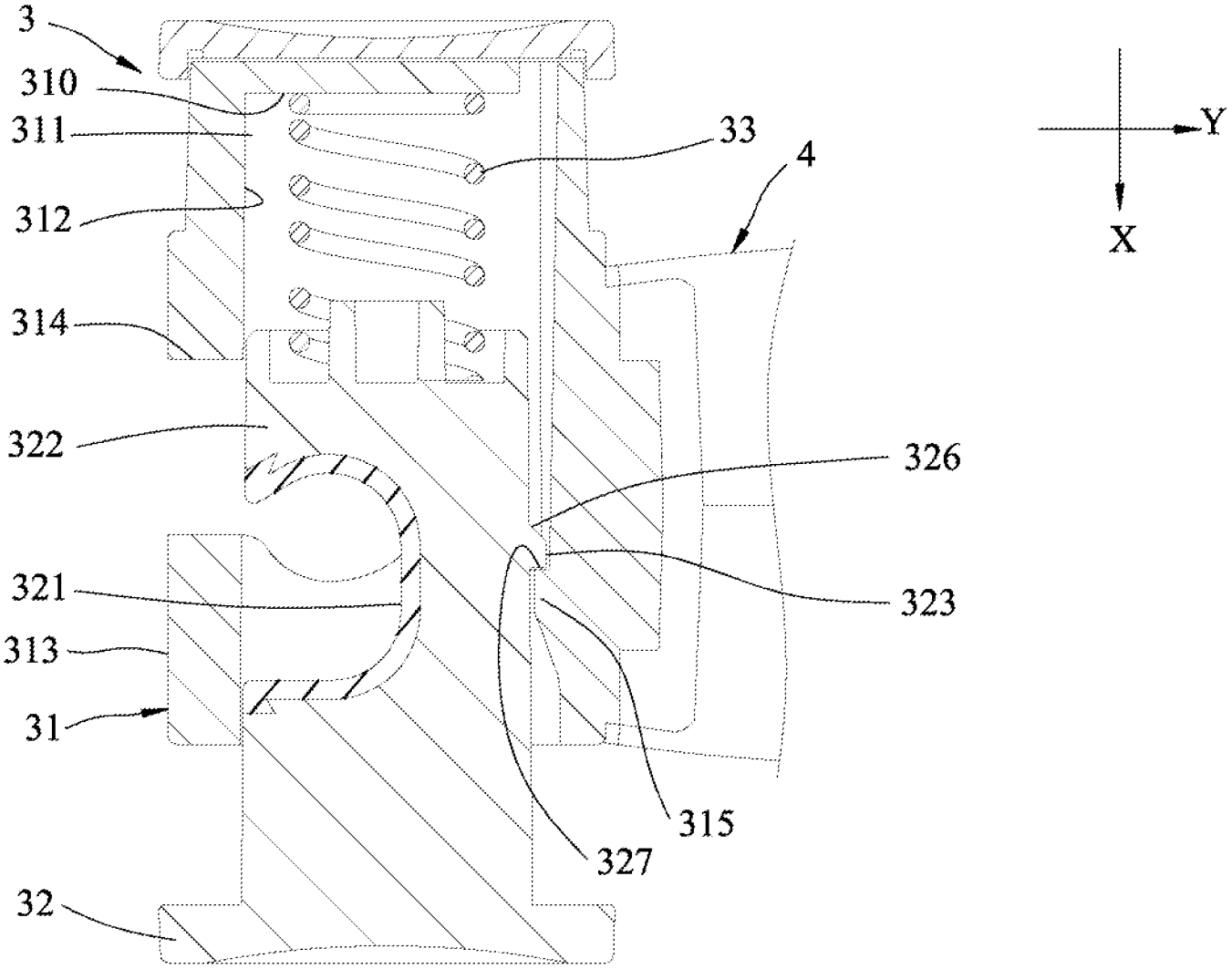
FIG. 4 is a sectional view taken along line IV-IV in FIG. 3, illustrating a clamping member in a fastened position.

Referring to FIGS. 2 to 4, the main body 31 of the first holding unit 3 has an inner surrounding surface 312 defining a passage 311, an outer surrounding surface 313 opposite to the inner surrounding surface 312, an edge wall surface 310 connected to an end of the inner surrounding surface 312, an opening 314 extending from the inner surrounding surface 312 to the outer surrounding surface 313, and a restraining portion 315 formed on the inner surrounding surface 312. The passage 311 is in spatial communication with the opening 314 and extends in a longitudinal direction (X). In this embodiment, the restraining portion 315 is a protruding portion.

The clamping member 32 of the first holding unit 3 is made of plastic materials, extends into the passage 311 and is movable in the longitudinal direction (X) and opposite to the longitudinal direction (X). The clamping member 32 has a hole 321 formed in an outer surface of the clamping member 32, a block portion 322 adjacent to the hole 321, and an abutment portion 323 formed on the cuter surface of the clamping member 32 for abutting against the restraining portion 315. In this embodiment, the abutment portion 323 is a protruding portion and is deformable when being urged. The abutment portion 323 has an inclined face 326 and an abutting face 327 that are arranged in the longitudinal direction (X). Specifically, the inclined face 326 extends obliquely from the outer surface of the clamping member 32. The abutting face 327 is substantially perpendicular to the outer surface of the clamping member 32. Similarly, the restraining portion 315 of the main body 31 has an abutting surface and an inclined surface that are arranged in the longitudinal direction (X) with the abutting surface being substantially perpendicular to the inner surrounding surface 312 and with the abutting surface being inclined relative to the inner surrounding surface 312. When coupling the clamping member 32 to the main body 31 during manufacturing of the embodiment of the musical instrument holder clip, the clamping member 32 is inserted into the passage 311, the inclined face 326 of the abutment portion 323 of the clamping surface 32 is in sliding contact with the inclined surface of the restraining portion 315 of the main body 31, and the abutment portion 323 of the clamping member 32 is urged by the restraining portion 315 of the main body 31 to deform, thereby permitting the abutment portion 323 to pass through the restraining portion 315. Once the abutment portion 323 passes through the restraining portion 315, the abutment portion 323 regains its initial form, and the abutting face 327 of the abutment portion 323 of the clamping member 32 faces the abutting surface of the restraining portion 315 of the main body 31.

The resilient member 33 is disposed in the passage 311 of the main body 31 between the edge wall surface 310 of the main body 31 and the clamping member 32. The resilient member 33 is operable for generating a clamping force to bias the clamping member 32 away from the edge wall surface 310.

Figure 5:
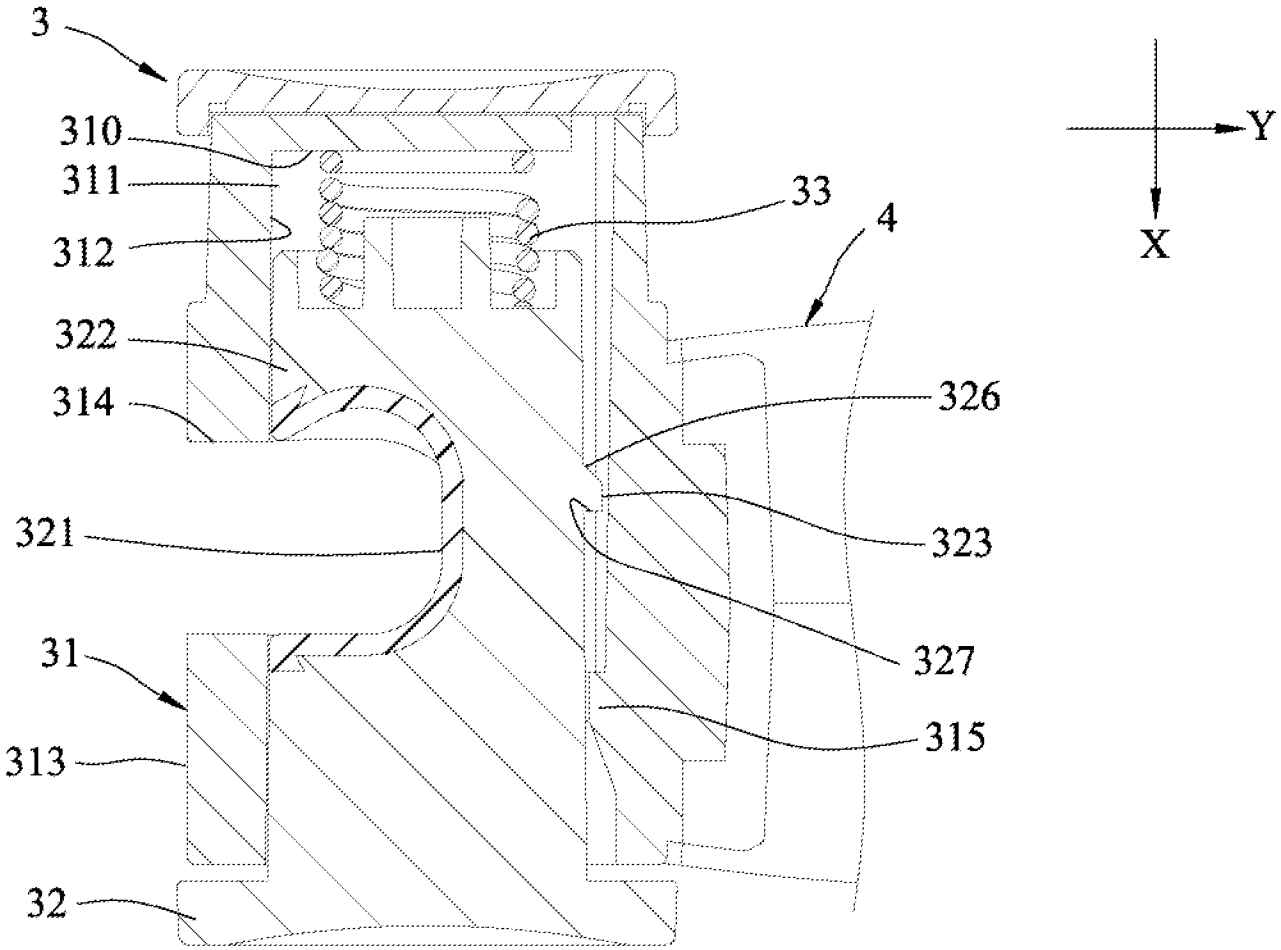
FIG. 5 is a sectional view similar to FIG. 4, but illustrating the clamping member in an open position.

Referring to FIGS. 3 to 5, the clamping member 32 is movable in the longitudinal direction (X) and opposite to the longitudinal direction (X) relative to the main body 31 between a fastened position (see FIG. 4), where the clamping member 32 is biased by the resilient member 33 away from the edge wall surface 310 and where the block portion 322 blocks a portion of the opening 314, and an open position (see FIG. 5), where the block portion 322 is away from the opening 314, and where an axis of symmetry of the hole 321 is registered with that of the opening 314. During the movement of the clamping member 32 from the fastened position to the open position, the clamping member 32 compresses the resilient member 33 to accumulate the clamping force for biasing the clamping member 32 toward the fastened position.

Referring to FIGS. 1 to 3, the second holding unit 4 includes a first holding member 41 and a second holding member 42 that are connected to the outer surrounding surface 313 of the main body 31. The first holding member 41 extends from the main body 31 in a transverse direction (Y). The first holding member 41 has an abutting surface 411 that is distal from the main body 31, and an indented portion 412 that is indented towards the main body 31. Specifically, the abutting surface 411 of the first holding member 41 is adapted for abutting against an outer surface of the bell wall 21 of the wind instrument 2.

The second holding member 42 is elastic, and has a connecting segment 421 that extends in a the transverse direction (Y) from the main body 31, a holding segment 422 that is spaced apart from the first holding member 41 and that extends in a normal direction (Z), and a curved segment 423 that interconnects the connecting segment 421 and the holding segment 422 and that opens towards the first holding member 41. In this embodiment, the second holding member 42 is made of sheet metal wrapped by plastic material. The second holding member 42 and the first holding member 41 cooperatively define a holding space 424 that is adapted for receiving the bell wall 21 of the wind instrument 2 therebetween. The indented portion 412 of the first holding member 41 is adapted for receiving the bell rim 211 of the bell wall 21 of the wind instrument 2. In addition, the holding segment 422 of the second holding member 42 has a distal end formed with a protruding portion 425 that is adapted for abutting against the inner surface of the bell wall 21 of the wind instrument 2. In this embodiment, the longitudinal direction (X), the transverse direction (Y), and the normal direction (2) are substantially perpendicular to one another.

It should be noted that the elastic property of the second holding member 42 allows the holding segment 422 to adjust the size of the holding space 424 during deformation processes of the second holding member 42, and the implementation of the curved segment 423 permits further deformation of the second holding member 42, such that the holding space 424 can be further enlarged for receiving the wind instrument 2.

Figure 6:
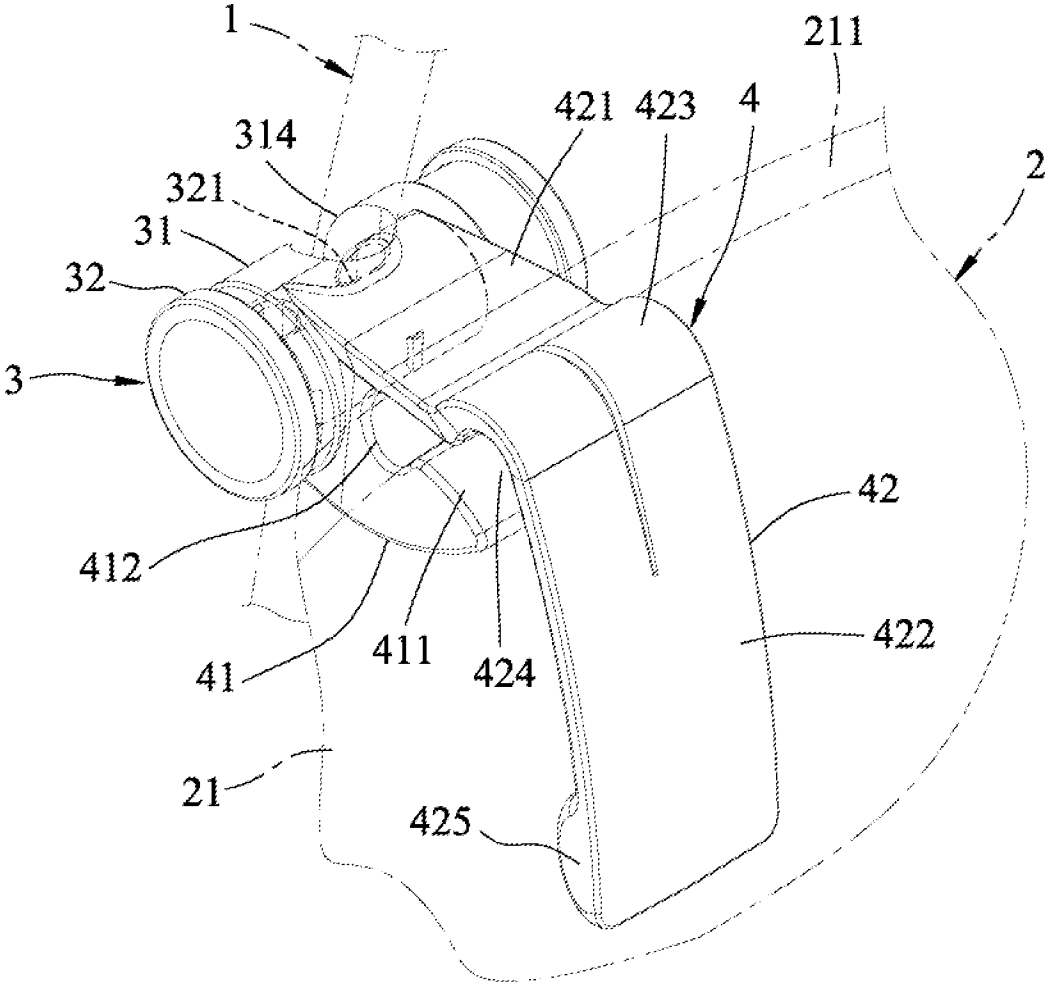
FIG. 6 is partly, fragmentary perspective view illustrating a use condition of the embodiment.

Referring to FIGS. 4 to 6, when using the microphone 1 to record sounds from the wind instrument 2, the embodiment needs to be slightly tilted and moved to abut the abutting surface 411 of the first holding member 41 against the outer surface of the bell wall 21 of the wind instrument 2 at a position near the bell rim 211. Then, the first holding member 3 is rotated towards the axis (L) (see FIG. 1) so as to cause the second holding member 4 to rotate accordingly. As such, a portion of the bell wall 21 of the wind instrument 2 engages the holding space 424 and the protruding portion 425 of the second holding member 42 abuts against the inner surface of the bell wall 21 of the wind instrument 2. Therefore, the embodiment of the musical instrument holder clip is secured to the wind instrument 2. For holding the microphone 1, the clamping member 32 needs to be pushed to move to the open position, so that the microphone 1 can be placed in an open space where the axis of symmetry of the hole 321 of the clamping member 32 is registered with that of the opening 314 of the main body 31. Then, the clamping member 32 needs to be released, and the resilient member 33 exerts the clamping force to move the clamping member 32 to the fastened position, and to hold the microphone 1 between the clamping member 32 and the main body 31. By virtue of the above-mentioned configurations, the microphone 1 is securely positioned into this embodiment and is co-movable with the wind instrument 2 for improved sound recording.

When detaching the microphone 1 from this embodiment, the clamping member 32 needs to be pushed to the open position, and the microphone 1 can be picked up from the open space where the axis of symmetry of the hole 321 of the clamping member 32 is registered with that of the opening 314 of the main body 31. When removing this embodiment from the wind instrument 2, the holding segment 422 of the second holding member 42 needs to be pulled away from the bell wall 21 of the wind instrument 2, such that the holding space 424 is widened and this embodiment can be detached from wind instrument 2. If the clamping member 32 is pushed by the resilient member 33 to move beyond the fastened position, the abutting face 327 of the abutment portion 323 of the clamping member 32 will abut against the restraining portion 315 of the main body 31 to prevent the clamping member 32 from falling off of the passage 311.

The benefits of this embodiment according to the disclosure can be summarized in the following. First, this embodiment applies simple urging and fastening movements, without additional tools or locking members, to fasten the microphone 1 onto the wind instrument 2. In addition, the microphone 1 is movable with the wind instrument 2 for improved sound recording. Secondly, with the elastic property of the second holding member 42 and spacing configuration by the first holding member 41, the second holding unit 4 is capable of receiving various types of wind instruments 2 at different sizes or forms, as the holding space 424 between the first holding member 41 and the second holding member 42 can be adjusted to meet different thickness of the bell wall 21.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A musical instrument holder clip adapted for detachably interconnecting a microphone and a wind instrument which includes a bell wall, said musical instrument holder clip comprising:

a first holding unit including a main body and a clamping member that extends movably into said main body, said first holding unit being operable to generate a clamping force between said main body and said clamping member that is adapted for clamping the microphone therebetween; and a second holding unit including a first holding member that is connected to an outer surrounding surface of said main body, and a second holding member that is elastic and that is connected to said outer surrounding surface of said main body, said first holding member being adapted for abutting against an outer surface of the bell wall of the wind instrument, said second holding member being adapted for abutting against an inner surface of the bell wall of the wind instrument, said first holding member and said second holding member cooperatively defining a holding space that is adapted for receiving the bell wall of the wind instrument therebetween.

2. The musical instrument holder clip as claimed in claim 1, wherein said main body of said first holding unit has an inner surrounding surface opposite to said outer surrounding surface and defining a passage, and an opening extending from said inner surrounding surface to said outer surrounding surface, said passage being in spatial communication with said opening and extending in a longitudinal direction, said clamping member extending into said passage and being movable in the longitudinal direction and opposite to the longitudinal direction.

3. The musical instrument holder clip as claimed in claim 2, wherein:

said main body further has an edge wall surface connected to an end of said inner surrounding surface; and said clamping member of said first holding unit has a hole formed in an outer surface of said clamping member, and a block portion adjacent to said hole, said clamping member being movable in the longitudinal direction and opposite to the longitudinal direction relative to said main body between a fastened position, where said clamping member is biased away from said edge wall surface and where said block portion blocks a portion of said opening, and an open position, where said block portion is away from said opening, and where an axis of symmetry of said hole is registered with that of said opening.

4. The musical instrument holder clip as claimed in claim 2, wherein:

said main body further has an edge wall surface connected to an end of said inner surrounding surface; and said first holding unit further includes a resilient member disposed in said passage of said main body between said edge wall surface of said main body and said clamping member, and being operable for generating the clamping force to bias said clamping member away from said edge wall surface of said main body.

5. The musical instrument holder clip as claimed in claim 2, wherein said main body further has a restraining portion formed on said inner surrounding surface, said clamping member having an abutment portion formed on an outer surface of said clamping member for abutting against said restraining portion.

6. The musical instrument holder clip as claimed in claim 1, wherein said first holding member of said second holding unit has an abutting surface that is distal from said main body of said first holding unit, and an indented portion that is indented towards said main body of said first holding unit, said abutting surface of said first holding member of said second holding unit being adapted for abutting against the outer surface of the bell wall of the wind instrument/said indented portion being adapted for receiving a bell rim of the bell wall of the wind instrument.

7. The musical instrument holder clip as claimed in claim 1, wherein said second holding member is made of sheet metal wrapped by plastic materials.

8. The musical instrument holder clip as claimed in claim 1, wherein said clamping member is movable in a longitudinal direction and opposite to the longitudinal direction/said first holding member extending from said main body of said first holding unit in a transverse direction which is substantially perpendicular to the longitudinal direction, said second holding member having a connecting segment that extends in the transverse direction from said main body, and a holding segment that is spaced apart from said first holding member and that extends in a normal direction being substantially perpendicular to the longitudinal direction and the transverse direction, said holding segment being adapted for abutting against the inner surface of the bell wall of the wind instrument.

9. The musical instrument holder clip as claimed in claim 8, wherein said holding segment of said second holding member has a distal end formed with a protruding portion that is adapted for abutting against the inner surface of the bell wall of the wind instrument.

10. The musical instrument holder clip as claimed in claim 8, wherein said second holding member further has a curved segment that interconnects said connecting segment and said holding segment and that opens towards said first holding member.

* * * * *